US006547514B2

(12) United States Patent
Lee

(10) Patent No.: US 6,547,514 B2
(45) Date of Patent: Apr. 15, 2003

(54) TECHNIQUE FOR PRODUCING A HIGH GAS-TO-LIQUID RATIO FLUID

(75) Inventor: Woon Y. Lee, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/877,456

(22) Filed: Jun. 8, 2001

(65) Prior Publication Data

US 2002/0187037 A1 Dec. 12, 2002

(51) Int. Cl.[7] ..... F04D 13/08

(52) U.S. Cl. ..... 415/1; 415/72; 415/199.4; 415/199.6; 415/143

(58) Field of Search ..... 415/72, 169.1, 415/199.4, 199.6, 199.5, 143; 417/423.3, 424.1, 424.2

(56) References Cited

U.S. PATENT DOCUMENTS 1,711,045 A * 4/1929 Davis ..... 415/143
2,969,742 A * 1/1961 Arutunoff ..... 415/143
3,303,989 A 2/1967 Rurik et al.
4,409,504 A 10/1983 Wilson et al.
4,548,263 A 10/1985 Woods
4,830,584 A 5/1989 Mohn
5,160,240 A 11/1992 Wilson
5,207,810 A * 5/1993 Sheth ..... 55/406
5,209,577 A 5/1993 Swatek
5,375,976 A 12/1994 Arnaudeau
5,404,943 A 4/1995 Strawn
5,482,117 A * 1/1996 Kolpak et al. ..... 166/265
5,562,405 A 10/1996 Ryall
5,628,616 A 5/1997 Lee
5,792,717 A * 8/1998 Takayama ..... 384/907.1
5,961,282 A 10/1999 Wittrisch et al.
6,048,168 A 4/2000 Sabini
6,190,141 B1 * 2/2001 Henry ..... 417/423.3

* cited by examiner

*Primary Examiner*—Ninh H. Nguyen
(74) *Attorney, Agent, or Firm*—Fletcher, Yoder & Van Someren; Jeffrey Griffin; Brigitte Jeffery

(57) ABSTRACT

A technique for facilitating the movement of multi-phase fluids. The technique utilizes a compressor pump and a production pump. The compressor pump compresses a fluid to remove vapor phase and then discharges the pressurized fluid to a production pump. The production pump produces the pressurized fluid to a desired location with greater efficiency due to reduction of the vapor phase.

40 Claims, 5 Drawing Sheets

TECHNIQUE FOR PRODUCING A HIGH GAS-TO-LIQUID RATIO FLUID

FIELD OF THE INVENTION

The present invention relates generally to movement of fluid, such as a high gas-to-liquid ratio fluid, and particularly to the use of multiple pumps, in which at least one pump pressurizes the fluid and delivers the pressurized fluid to a production pump.

BACKGROUND OF THE INVENTION

Certain types of pumps, such as centrifugal pumps, can lose efficiency or even be damaged when pumping multi-phase fluids having a relatively high gas content. For example, such pumps often are used in the production of subterranean fluids, such as oil, where the fluid can exist in a multi-phase form within the reservoir. In one type of application, a wellbore is drilled into the reservoir of desired fluid, and a pumping system is deployed in the wellbore to raise the desired fluid. The pumping system may comprise an electric submersible pumping system that utilizes a submersible motor to power a production pump, such as a centrifugal pump. When the produced fluid is a multi-phase fluid comprising oil and gas, performance of the pumping system can be substantially limited.

SUMMARY OF THE INVENTION

The present invention relates generally to a technique for moving fluids having a relatively high gas-to-liquid ratio, such as certain fluids produced from subterranean reservoirs. The technique can be utilized with, for example, an electric submersible pumping system used within a wellbore for the production of oil. Of course, the technique may have applications in other environments and with other types of fluid.

In this technique, a compressor pump is employed to compress the vapor phase in a multi-phase fluid. This pressurized fluid is then delivered to a production pump that moves the fluid to a desired location. By delivering fluid to the production pump with reduced or eliminated vapor phase, the efficiency and longevity of various types of production pumps can be improved.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Figure 1:
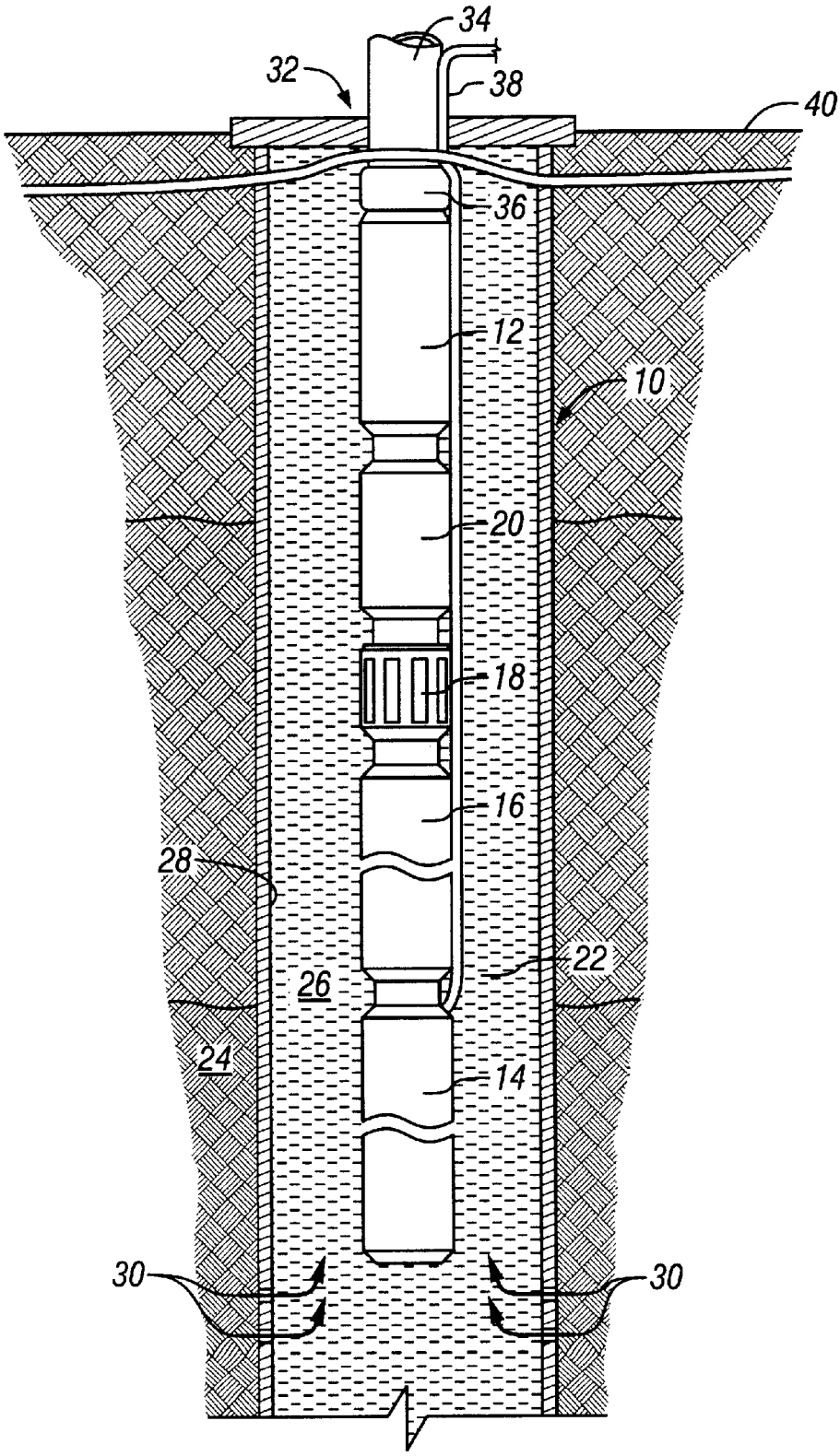
FIG. 1 is a front elevational view of an exemplary electric submersible pumping system disposed within a wellbore.

Referring generally to FIG. 1, an exemplary application of the inventive technique is illustrated. Although this is one embodiment of the invention, a variety of other applications and environments may benefit from the inventive technique disclosed herein. In this embodiment, an electric submersible pumping system 10 is illustrated. Submersible pumping system 10 comprises a variety of components depending on the particular application in which it is used. Typically, system 10 comprises at least a production pump 12 which, in this application, is a centrifugal pump. The system also comprises a submersible motor 14 that powers production pump 12. Typically, a motor protector 16 is coupled to motor 14 to isolate internal motor fluids from wellbore fluids. Furthermore, submersible pumping system 10 comprises a fluid intake 18 and a vapor phase reduction or compressor pump 20. (See also FIG. 2)

In the illustrated example, submersible pumping system 10 is designed for deployment in a well 22 within a geological formation 24 containing desirable production fluids, such as petroleum. In this application, a wellbore 26 is drilled and lined with a wellbore casing 28. Wellbore casing 28 typically has a plurality of openings 30, e.g. perforations, through which production fluids flow into wellbore 26.

Submersible pumping system 10 is deployed in wellbore 26 by a deployment system 32 that also may have a variety of forms and configurations. For example, deployment system 32 may comprise tubing 34 connected to electric submersible pumping system by a connector 36. Power is provided to submersible motor 14 via a power cable 38. Submersible motor 14, in turn, powers production pump 12 and compressor pump 20 which draws production fluid in through pump intake 18 and pumps the production fluid to production pump 12. Production pump 12 then pumps or produces the fluid to a collection location 40, e.g. at the surface of the earth. In this embodiment, production pump 12 produces fluid through tubing 34.

It should be noted that the illustrated electric submersible pumping system 10 is an exemplary embodiment. Other components can be added to this system and other deployment systems may implemented. Additionally, the production fluids may be pumped to the surface through tubing 34 or through the annulus formed between deployment system 32 and wellbore casing 28. These and other modifications, changes or substitutions may be made to the illustrated system.

Figure 2:
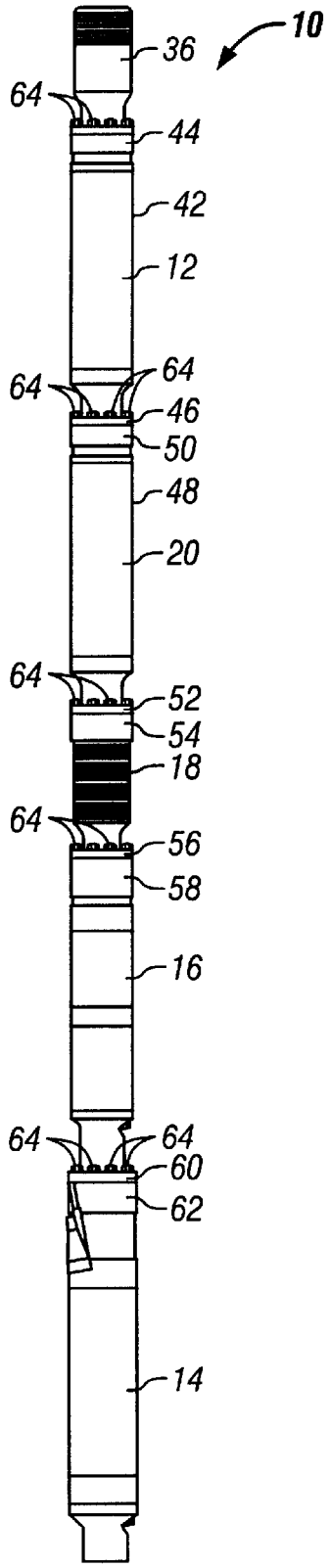
FIG. 2 is a front elevational view of an exemplary electric submersible pumping system utilizing the present technique.

As illustrated best in FIG. 2, the various components of electric submersible pumping system 10 are coupled together at appropriate mounting ends. For example, production pump 12 typically includes an outer housing 42 having an upper mounting end 44 and a lower mounting end 46. Similarly, compressor pump 20 comprises an outer housing 48 having an upper mounting end 50 and a lower mounting end 52. Intake 18 also has an upper mounting end 54 and a lower mounting end 56; motor protector 16 has an upper mounting end 58 and a lower mounting end 60; and submersible motor 14 has at least an upper mounting end 62.

The various mounting ends permit each of the components to be selectively coupled to the next adjacent components for assembly of a desired electric submersible pumping system 10. This modular approach permits individual components to be substituted, removed, repaired and/or rearranged. In the embodiment illustrated, adjacent mounting ends are held together by appropriate fasteners, such as bolts 64.

The illustrated production pump 12 and compressor pump 20 are separate or independent units that may be selectively and independently coupled into electric submersible pumping system 10 at a variety of locations. In the present embodiment, compressor pump 20 is coupled to production pump 12 at a location upstream from production pump 12. In this manner, compressor pump 20 receives wellbore fluid through intake 18 and sufficiently compresses the wellbore fluid to remove undesired pockets of vapor phase in the wellbore fluid. The pressurized fluid is discharged directly to production pump 12, e.g. a centrifugal pump. With the vapor phase removed or substantially reduced, production pump 12 is able to efficiently produce fluid to desired location 40.

Figure 3:
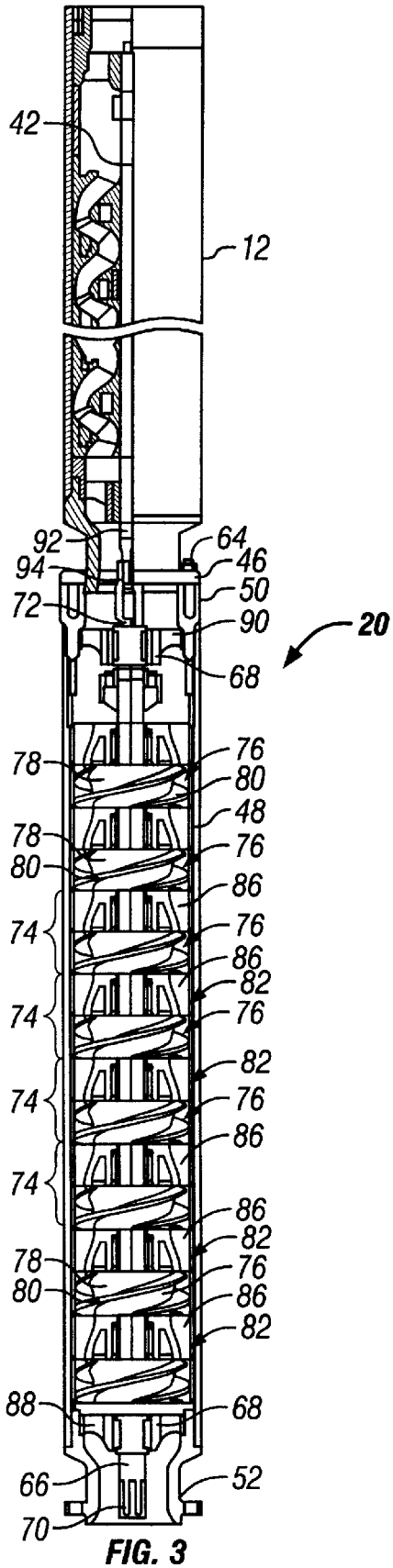
FIG. 3 is a partial cross-sectional view taken generally along the axis of a production pump and a compressor pump, according to one aspect of the present invention.

As illustrated in FIG. 3, a desirable compressor pump 20 comprises a helico-axial pump contained within its own separate housing 48. As described above, housing 48 has an upper mounting end 50 that may be selectively coupled to the next adjacent component which, in this case, is production pump 12 and specifically lower mounting end 46 of production pump 12. The mounting ends may be standard mounting ends used with components of electric submersible pumping systems. To aid explanation, compressor pump 20 will hereinafter be referred to as helico-axial pump 20.

Helico-axial pump 20 comprises a central or axial shaft 66 that is rotated or powered by submersible motor 14. Shaft 66 is rotatably mounted within housing 48 by appropriate bearing structures 68. Typically, shaft 66 comprises a splined lower end 70 and a splined upper end 72 to facilitate coupling to corresponding shaft segments in adjacent components. Furthermore, shaft 66 typically extends through a plurality of stages 74. The number of stages will vary according to the level of pressurization desired for a given environment or application. However, the embodiment illustrated in FIG. 3 shows eight stages 74.

Figure 4:
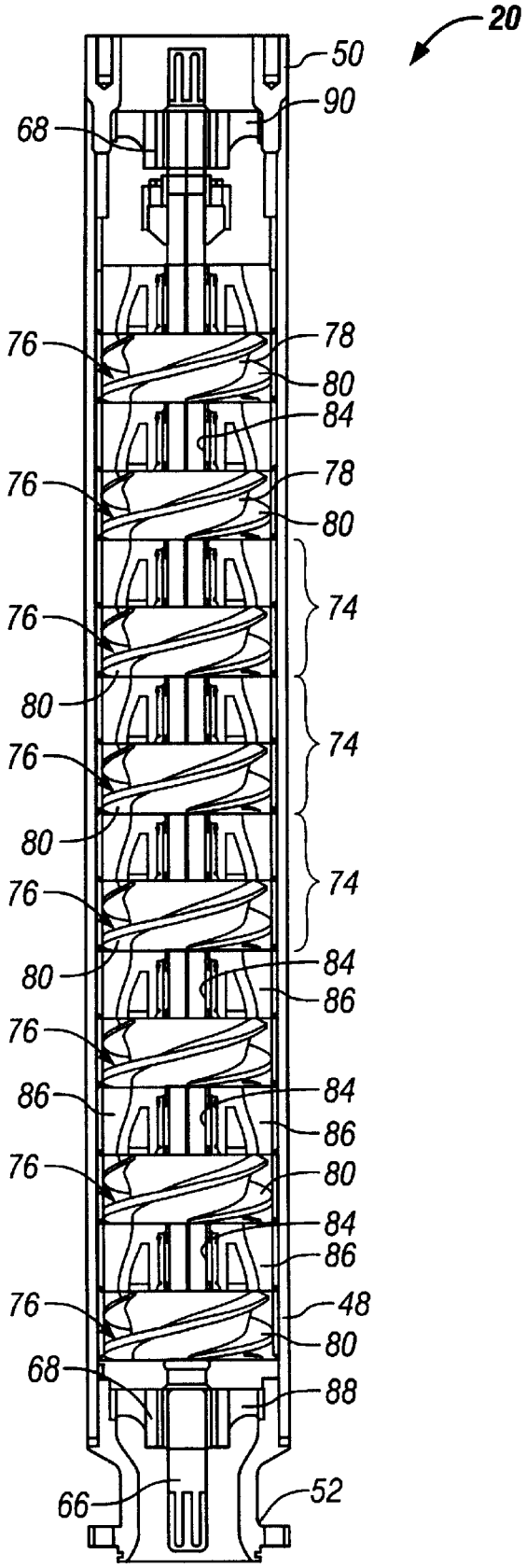
FIG. 4 is a cross-sectional view of the compressor pump illustrated in FIG. 3 taken generally along the axis of the pump.
Figure 5:
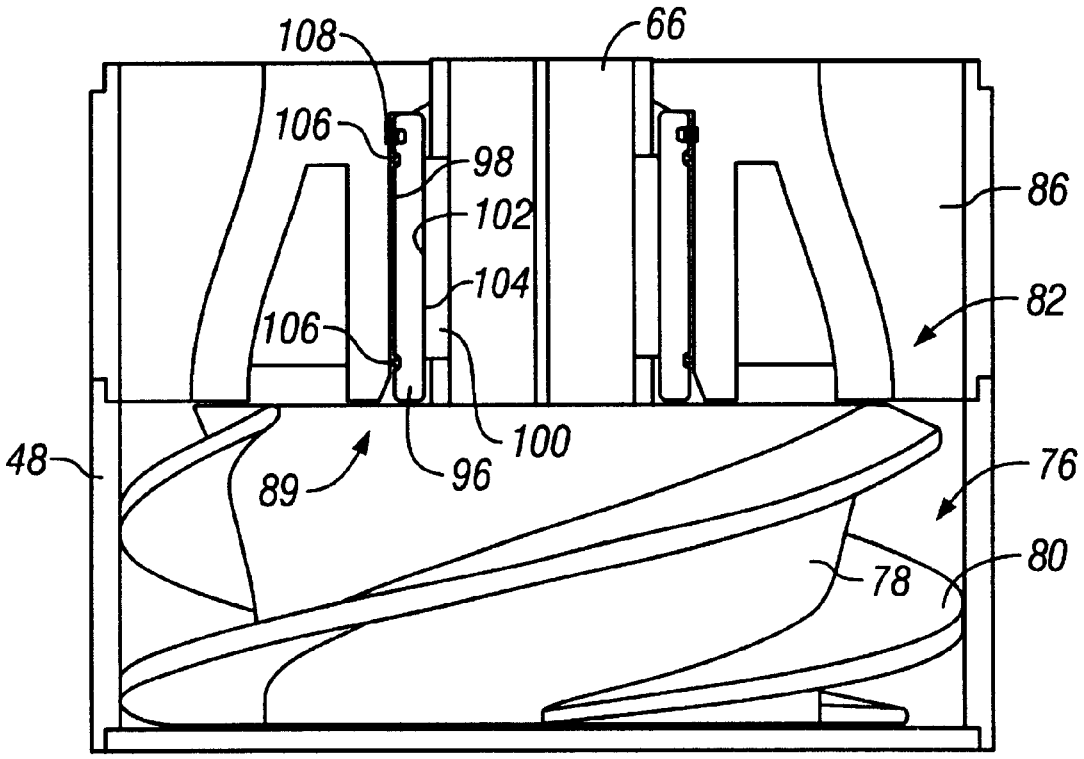
FIG. 5 is an enlarged view of a portion of a stage similar to those illustrated in FIG. 4.

Each stage 74 comprises a helical impeller 76 rotationally affixed to shaft 66. The helical impeller 76 may be rotationally affixed to shaft 66 in a variety of ways known to those of ordinary skill in the art, such as through the use of a key and keyway (not shown). As illustrated best in FIGS. 4 and 5, each helical impeller 76 comprises a central hub portion 78 and a fin 80 helically wrapped about central hub portion 78.

Each stage 74 also comprises a diffuser 82 designed to direct fluid discharged from the corresponding helical impeller 76. An exemplary diffuser 82 is rotationally affixed with respect to housing 48 and comprises a central opening 84 to rotatably receive shaft 66 therethrough. Each diffuser 82 further comprises a flow channel 86 through which fluid is directed upwardly upon discharge from helical fin 80 of the subsequent, lower helical impeller 76. In this design, a bearing assembly or bearing unit 89 is combined with at least some and often all of the diffusers 82 to promote longevity of the pump.

When shaft 66 and helical impellers 76 are rotated, fluid is drawn through a housing inlet 88 from intake 18 and directed upwardly through each stage until discharged through a housing outlet 90 to production pump 12. In the embodiment illustrated, shaft 66 is coupled to a shaft 92 of production pump 12 by an appropriate coupling device 94. Thus, rotation of shaft 66 causes rotation of shaft 92 in production pump 12. Generally shaft segments 66 and 92, as well as other shaft segments for additional components, each have a single diameter. It should be noted that the production pump 12 illustrated in FIG. 3 is a centrifugal pump as is commonly used in electric submersible pumping systems for the production of wellbore fluids. However, other types of production pumps also may be utilized in some applications.

The helico-axial pump 20 is designed to generate a lower head than centrifugal pump 12. Also, the efficiency of the helico-axial pump 20 may be lower than that of the production pump provided it is able to compress the vapor phase in the fluid to a level the centrifugal pump 12 is able to handle without substantial, detrimental head degradation. The use of a helico-axial pump to remove vapor phase is particularly beneficial and, in combination with a centrifugal pump, has resulted in substantially improved production parameters. Additionally, the modular design of the system with separate pump housings and separate shafts connected by coupling device 94 permit ease of assembly, disassembly, servicing, replacement, etc. of either or both pumps.

Furthermore, bearing assemblies 89 promote longevity and reliability of pump 20. In the embodiment illustrated in FIG. 5, the bearing assemblies 89 are combined with individual diffusers 82 to provide a combined diffuser/bearing unit. The exemplary bearing assembly 89 comprises a radial bearing 96 mounted in a bearing seat or receiving area 98 of diffuser 82. An annular bushing 100 is mounted to shaft 66 and deployed radially inward from radial bearing 96. Typically, annular bushing 100 is rotationally affixed to shaft 66 such that a radially outer surface 102 of annular bushing 100 slides against a radially inward surface 104 of radial bearing 96.

As illustrated, one or more, e.g. two, O-rings 106 may be deployed between radial bearing 96 and bearing receiving area 98. The O-rings 106 are resilient and allow for a slight amount of movement of radial bearing 96 to accommodate slight variations in shaft 66. Additionally, a retainer ring 108 may be used to position radial bearing 96 within bearing receiving area 98. Radial bearings 96 and corresponding annular bushings 100 can be deployed at each stage or selected stages, such as every other stage.

Figure 6:
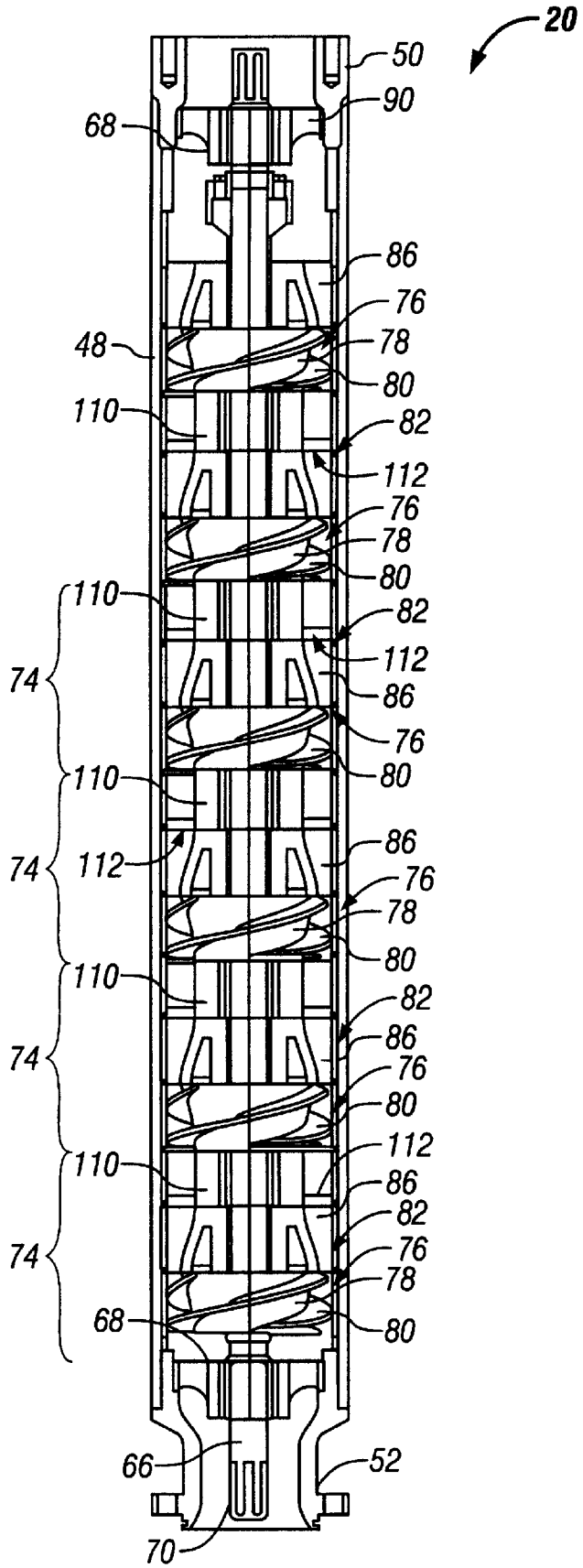
FIG. 6 is a cross-sectional view similar to that of FIG. 4 but showing an alternate embodiment of the pump.

An alternate embodiment of helico-axial pump 20, labeled 20', is illustrated in FIG. 6. In this embodiment, a separate bearing unit 110 is disposed between several of the helical impellers 76 and diffusers 82. For example, the various components may be sequentially arranged from bottom to top in the order: helical impeller 76, diffuser 82, bearing unit 110, helical impeller 76, diffuser 82, bearing unit 110, etc. Each bearing unit 110 has a flow path 112 to permit the flow of fluid therethrough. Bearing units 110 typically are utilized in place of the bearing assemblies 89 discussed above with reference to FIGS. 4 and 5. Bearing units 110 can be designed, for example, to incorporate radial bearings and annular bushings similar to those described above with respect to bearing assemblies 89.

Because the gaseous phase has a tendency to accumulate in the radial center of the pump, lack of lubrication between bearing and shaft can become a problem in certain environments or applications. Accordingly, bearing structures 68, radial bearings 96, annular bushings 100, and bearing units 110 can be designed with wear-resistant materials for such applications. Exemplary materials comprise ceramic materials, such as zirconia and silicon carbide. In the embodiment illustrated in FIGS. 4 and 5, for example, both the radial bearing 96 and annular bushing 100 can be made from ceramic materials. Use of such materials prolongs the useful life of helico-axial pumps 20 and 20'.

It will be understood that the foregoing description is of exemplary embodiments of this invention, and that the invention is not limited to the specific forms shown. For example, the technique may be useful in other applications and environments in which multi-phase fluids are pumped from one location to another; a variety of electric submersible pumping system components may be added, changed or substituted for the components illustrated and described; the number of stages used in either the compressor pump or production pump can be adjusted; and the materials utilized may vary. These and other modifications may be made in the design and arrangement of the elements without departing from the scope of the invention as expressed in the appended claims.

What is claimed is:

1. A production system designed for use in a wellbore to produce a fluid, comprising:

a modular electric submersible pumping system having:

a submersible motor;

a submersible pump powered by the submersible motor; and a helico-axial compressor pump independent from the submersible pump, the helico-axial compressor pump being positioned upstream from the submersible pump.

2. The production system as recited in claim 1, wherein the submersible pump and the helico-axial compressor pump each comprises a shaft segment, the individual shaft segments each having a single diameter.

3. The production system as recited in claim 1, wherein the helico-axial compressor pump is coupled directly to the submersible pump.

4. The production system as recited in claim 1, wherein the submersible pump comprises a centrifugal pump.

5. The production system as recited in claim 3, wherein the submersible pump comprises a centrifugal pump.

6. The production system as recited in claim 1, further comprising a pump intake for both the submersible pump and the helico-axial compressor pump, the pump intake being disposed upstream of the helico-axial compressor pump.

7. The production system as recited in claim 6, further comprising a motor protector coupled to the submersible motor.

8. The production system as recited in claim 1, wherein the helico-axial compressor pump generates a lower head than the submersible pump.

9. The production system as recited in claim 1, wherein the helico-axial compressor pump comprises a plurality of stages.

10. The production system as recited in claim 9 wherein each stage of the plurality of stages comprises a helical impeller.

11. The production system as recited in claim 9, wherein each stage of the plurality of stages comprises a diffuser.

12. The production system as recited in claim 9, wherein each stage of the plurality of stages comprises a bearing structure.

13. The production system as cited in claim 12, wherein each bearing structure comprises a ceramic wear material.

14. The production system as recited in claim 13, wherein the ceramic wear material comprises zirconia.

15. The production system as recited in claim 13, wherein the ceramic wear material comprises silicon carbide.

16. The production system as cited in claim 12, wherein each bearing structure comprises a radial bearing.

17. A pumping system, comprising:

a centrifugal pump having a centrifugal pump housing; and a helico-axial compressor pump having a helico-axial compressor pump housing, wherein the centrifugal pump housing and the helico-axial compressor pump housing are removably coupled together.

18. The pumping system as recited in claim 17, wherein the helico-axial compressor pump is disposed at an upstream position relative to the centrifugal pump.

19. The pumping system as recited in claim 18, wherein the centrifugal pump housing and the helico-axial compressor pump housing are removably coupled together by a plurality of bolts and a pair of engageable shaft segments, each shaft segment having a single diameter.

20. The pumping system as recited in claim 19, wherein the helico-axial compressor pump generates less head than the centrifugal pump.

21. The pumping system as recited in claim 17, wherein the helico-axial compressor pump comprises a plurality of stages, each stage having a radial bearing.

22. A production system disposed in a wellbore to produce a fluid, comprising:

a submersible motor;

a submersible production pump powered by the submersible motor; and a compressor pump positioned to pressurize a wellbore fluid to be produced by the submersible production pump, wherein the compressor pump generates less head than the submersible production pump.

23. The production system as recited in claim 22, wherein the compressor pump comprises a helico-axial pump.

24. The production system as recited in claim 23, wherein the submersible production pump comprises a centrifugal pump.

25. The production system as recited in claim 24, wherein the helico-axial pump is coupled to the centrifugal pump by a plurality of fasteners.

26. The production system as recited in claim 25, wherein the helico-axial pump comprises a plurality of stages.

27. The production system as recited in claim 26, wherein each stage of the plurality of stages comprises a helical impeller.

28. The production system as recited in claim 27, wherein each stage of the plurality of stages comprises a diffuser.

29. The production system as recited in claim 27, wherein each stage of the plurality of stages comprises a bearing.

30. A method of facilitating the production of a relatively high gas-to-liquid ratio fluid from a subterranean environment, comprising:

drawing a wellbore fluid through a pump intake;

pressurizing the wellbore fluid in a helico-axial pump;

discharging the wellbore fluid to a separate production pump following pressurizing; and producing the wellbore fluid to a collection point.

31. The method as recited in claim 30, wherein discharging comprises discharging the wellbore fluid to a centrifugal pump.

32. The method as recited in claim 31, further comprising coupling the helico-axial pump directly to the centrifugal pump.

33. The method as recited in claim 32, further comprising powering the helico-axial pump and the centrifugal pump with a submersible motor.

34. The method as recited in claim 33, wherein pressurizing the wellbore fluid comprises pumping the wellbore fluid through a plurality of stages each having a helical impeller.

35. The method as recited in claim 33, wherein producing comprises producing the wellbore fluid through a tubing.

36. The method as recited in claim 32, further comprising forming the helico-axial pump with a standard connection end to permit selective coupling of the helico-axial pump with other production pumps.

37. A system of facilitating the production of a relatively high gas-to-liquid ratio fluid from a subterranean environment, comprising:

means for drawing a wellbore fluid through a pump intake;

means for pressurizing the wellbore fluid in a compressor pump; and means for discharging the wellbore fluid to a separate production pump following pressurizing.

38. The system as recited in claim 37, further comprising means for producing the wellbore fluid to a collection point.

39. The system as recited in claim 37, wherein the means for pressurizing comprises a helico-axial pump.

40. The system as recited in claim 39, wherein the separate production pump comprises a centrifugal pump.

* * * * *